US007644461B2

(12) United States Patent
Lee

(10) Patent No.: US 7,644,461 B2
(45) Date of Patent: Jan. 12, 2010

(54) FOAM INTEGRATED INNERSPRING MATTRESS AND METHOD OF MANUFACTURE

(75) Inventor: Youn Jae Lee, Pleasanton, CA (US)

(73) Assignee: Zinus, Inc., Pleasanton, CA (US)

( * ) Notice: Subject to any disclaimer, the term of this patent is extended or adjusted under 35 U.S.C. 154(b) by 129 days.

(21) Appl. No.: 11/464,437

(22) Filed: Aug. 14, 2006

(65) Prior Publication Data

US 2007/0204407 A1 Sep. 6, 2007

(51) Int. Cl.
*A47C 27/07* (2006.01)
*A47C 27/05* (2006.01)

(52) U.S. Cl. ..... 5/720; 5/655.8

(58) Field of Classification Search ..... 5/720, 5/721, 717, 716, 654.1, 655.7, 655.8, 739
See application file for complete search history.

(56) References Cited

U.S. PATENT DOCUMENTS 2,446,775 A * 8/1948 Marsack ..... 5/720
2,536,310 A * 1/1951 Reed ..... 297/452.51
2,862,214 A * 12/1958 Thompson et al. ..... 5/720
3,099,021 A * 7/1963 Wetzler ..... 5/718
3,165,761 A * 1/1965 Ross ..... 5/655.8
3,178,735 A * 4/1965 Thompson et al. ..... 5/720
3,251,078 A * 5/1966 Calla ..... 5/655.8
3,310,819 A * 3/1967 Morrison ..... 267/143
3,401,411 A * 9/1968 Morrison ..... 5/655.8
3,425,068 A * 2/1969 Bechtoldt ..... 5/655.8
3,462,779 A * 8/1969 Thompson ..... 5/655.8
3,869,739 A * 3/1975 Klein ..... 5/720
4,429,427 A * 2/1984 Sklar ..... 5/654.1
4,485,506 A * 12/1984 Stumpf et al. ..... 5/655.8
5,040,255 A * 8/1991 Barber, Jr. ..... 5/720
6,643,876 B2 * 11/2003 Visser et al. ..... 5/720
6,952,850 B2 * 10/2005 Visser et al. ..... 5/690
2004/0148706 A1 * 8/2004 Visser et al. ..... 5/720
2007/0204407 A1 * 9/2007 Lee ..... 5/720
2008/0263774 A1 * 10/2008 Lee ..... 5/691

* cited by examiner

*Primary Examiner*—Robert G Santos

(57) ABSTRACT

This invention relates to a foam integrated innerspring mattress and method of manufacture wherein a flexible polyurethane foam is adhered onto the top and bottom of individually wrapped pocket innersprings, and additional polyurethane foam is molded onto the sides of the mattress.

5 Claims, 4 Drawing Sheets

FOAM INTEGRATED INNERSPRING MATTRESS AND METHOD OF MANUFACTURE

BACKGROUND OF THE INVENTION

1. Field of the Invention

This invention relates to foam integrated innerspring mattresses and, in particular, to a method of manufacturing foam integrated innerspring mattresses wherein a flexible polyurethane foam is adhered onto the top and bottom of individually wrapped pocket innersprings, and additional polyurethane foam is molded onto the sides of the mattress. As used herein, the term "foam integrated innerspring mattress" is intended to be construed in its broadest sense. In general, a mattress is designed to provide support for a person sleeping thereon.

2. Reference to Related Art

Innerspring units formed of a unitary construction are known. For example, in U.S. Pat. No. 3,239,584 issued to Terry et al. on Mar. 8, 1966, a method of fabricating a seat or cushion using a combination construction of springs and resilient pads is shown. A spring wire element with an open mesh fabric placed thereon is used and a resilient foam is foamed through the open mesh fabric to bond the spring wire element, the open mesh fabric and the foam into a unitary structure. The structure is used primarily to manufacture seats for vehicles.

In U.S. Pat. No. 3,920,609 issued to Lehmann on Nov. 18, 1975, a method of producing a spring core mattress using coil springs that are at least partially embedded in cover plates is shown. The cover plates are positioned so as to be substantially parallel to each other while the coil springs are under a preload and are surrounded by foam material to hold them in their respective relative positions, The foam material is provided as foam sheets and is not foamed directly onto the cover plates.

U.S. Pat. No. 3,325,834 issued to Lovett et al on Jun. 20, 1967 shows a method of making an innerspring body supporting article. The innersprings are embedded in adhering particles of multi-cellular resilient spongy material in order to provide a sturdy long-lasting resilient unitary structure. The particles of resilient spongy material are coated with an adhesive prior to being deposited and pressed into a mold. The innerspring structure is completely covered with the coated particles and a unitary structure is formed when the adhesive sets. A divisional application of this patent issued as U.S. Pat. No. 3,452,127 on Jun. 24, 1969.

Other spring reinforced mattresses wherein a foam or other type of resilient material completely surrounds an innerspring are shown, for example, in U.S. Pat. No. 2,994,890 issued to Wagner on Aug. 8, 1961; U.S. Pat. No. 3,099,021 issued to Wetzler on Jul. 30, 1963; and U.S. Pat. No. 3,049,730 issued to Wall et al on Aug. 21, 1962. Wall et al specifically relates to a seat structure wherein a first layer of polyurethane foam is used to embed a spring. A second layer of a less dense polyurethane foam is provided on top of the first layer of foam in order to provide increased comfort.

U.S. Pat. No. 4,811,439 issued to Siegel on Mar. 14, 1989 discloses a method for producing a foamed innerspring unit comprising the steps of preparing a foamable reaction mixture, spraying it into a tray, loading an innerspring unit into it and permitting the foamable reaction mixture to rise to form a foam that is at least partially adhered to the unit.

U.S. Pat. No. 5,756,022 issued to Siegel on May 26, 1998 disclosed a method for forming a foamed innerspring unit including releasably securing a plurality of coils to a jig, delivering a foamable reaction mixture to a tray and positioning the jig so that the ends of the coils extending away from the jig are spaced from the bottom of the tray so that the rising foam embeds the end of the coil. The process is repeated by releasing the foamed layer embedding one end of the coils, releasably holding the first foam layer with the ends thereof spaced from a tray having said foamable reaction mixture therein so that the second end of the coils is embedded in a second foam layer.

SUMMARY OF THE INVENTION

In accordance with the instant invention, a mattress and method for manufacturing a foam integrated innerspring mattress is disclosed wherein individual spring coils are placed into sealable pockets. The pockets are preferably made from fabric, but could also be made from a variety of other materials, including but not limited to paper, plastic or other flexible material. Each of the The spring coils and pockets are preferably aligned such that a they are generally evenly spaced. However, additional embodiments may include variations where uneven spacing is preferable. Uneven spacing of coils may be preferable when variation in the amount of support over the surface of the mattress is desirable. Also, coils of differing stiffness can be selected to occupy different locations within the mattress to create differing zones of firmness.

The spring coils are generally the same length (or height). This allows for an alignment such that when they are placed in a side by side configuration, and their first ends are all facing in the same direction, the aggregation of their first ends will form a generally flat surface.

The pocket coils are arranged in a generally rectangular shape. The pockets on the periphery of the rectangular shaped arrangement may be connected or affixed such that the material surrounding the coils along the periphery of the mattress is connected and contiguous. This feature allows for liquid foam to be poured around the periphery of the mattress, while not allowing the foam to penetrate into the interior of the mattress area. The invention includes various configurations on the placement of the pocket coils. One such configuration places the connected pocket coils in a generally rectangular shaped spiral, where the pocket coils along the periphery are connected via their originally connected pocket material.

Another configuration places the connected pocket coils in a generally rectangular shape by creating rows (or columns) with the pocket coils. This configuration may require that the material on the periphery be glued or otherwise affixed such that a contiguous surface is created along the periphery to resist penetration of liquid foam.

Once the pocket coils are in place as described above, a first sheet or first layer of flexible foam is affixed to the first ends of the pocket coils. Preferably, the flexible foam is pre-formed for cost and convenience factors, but this is not a requirement of the invention. This is preferably accomplished using an adhesive applied to the first ends of the pocket coils before the layer of foam is applied. Alternatively, the adhesive may be applied to the pre-formed foam layer before placement onto the pocket coils. Similarly, a second sheet or second layer of pre-formed flexible foam is affixed to the second ends of the pocket coils utilizing the same methods as described above.

Once the pocket coils and foam layers are affixed as described herein, they are placed into a mold. The foam can be placed on all four sides of the mattress. Therefore, the mold preferably provides space between itself and all four sides of the mattress. Liquid foam, preferably polyurethane foam, is poured or injected into the mold. The liquid foam is allowed to come into contact with the pocket coil material on the periphery of the mattress. However, since the pocket material on the sides/periphery is connected and contiguous, the liquid foam does not substantially penetrate into the interior of the mattress. The liquid foam is then allowed to cure and become permanently affixed to the sides of the mattress. A purpose of the mold is to allow for the creation of foam sides/edges to the mattress. The foam sides bond with the pocket coils on the periphery of the mattress, thus providing support to the entire mattress. As such, the liquid foam, once it cures and becomes solid, provides edge support for the mattress.

Accordingly, it is an object of the invention to provide a method of manufacturing a foam integrated innerspring mattress with improved comfort, stability, and support.

The mattress, and method of manufacture described herein, offers substantial advantages over the prior art both in reduced expense of material for production and in substantial functional advantages. Among the functional advantages is not only the provision of a mattress wherein the individual coils can function more independently than in a conventional mattress where the coils are tied together by wires or the like, but the invention also provides a mattress where the foam edges become permanently integrated with the mattress and provides improved support and stability.

Generally, mattresses can be constructed using a variety of support systems, such as air, water, foam, or springs. The term "innerspring mattress" is used herein to describe any bedding apparatus that generally encloses springs in a compartment. The compartment that encloses the springs can be made from a variety of materials, including but not limited to foam, fabric, fiber, felt, or plastic. The material that encloses the springs can be made from any suitable material. The term "mattress" includes not only the typical finished consumer bedding product that typically contains fabric padding surrounding the apparatus, but may also include an apparatus that does not include any cover around the enclosed springs. Such a mattress is often referred to as a mattress "core". A mattress "core" could be packaged and/or sold separately from a mattress cover, wherein the cover can be placed on or around the core. Mattress covers could vary in attributes such as firmness and height. In any event, the term "mattress" as used herein may include a mattress "core", as well as a mattress that includes a covering.

The term "foam" can include materials such as latex foam, visco elastic foam and other polyurethane-type foams. The springs contained in mattresses are typically made from steel and usually provide at least a portion of the structure of the mattress. The term "spring" as used herein can include a variety of structures that provide or allow movement by elastic force. This includes the typical spiral shaped springs, but can also include other shapes or mechanisms, including but not limited to Z shaped springs, and/or spacers or other devices that provide structure and/or elastic force to the mattress.

The method described herein is ideally suited to foam integrated innerspring mattresses using pocket springs, due to the increased flexibility of pocket springs. However, foam encasement and/or pocket springs are not requirements or limitations of the invention. Preferably, pocket springs will be used that are individually wrapped with adhesive-bonded fabric. The adhesive-bonded fabric pockets are not only used for wrapping the spring, but also for isolating the springs from the foam material that encases them.

However, this method may also be utilized on other types of spring mattresses, including, but not limited to, Bonnel type springs that have knotted end turns on the springs.

The objects set forth above, among those apparent from the preceding description, are efficiently attained, and since certain changes may be made in the above constructions without departing from the spirit and scope of the invention, it is intended that all matter contained in the above and below descriptions or shown in the accompanying drawings shall be interpreted as illustrative and not in a limiting sense.

DETAILED DESCRIPTION OF THE DRAWINGS

Figure 1:
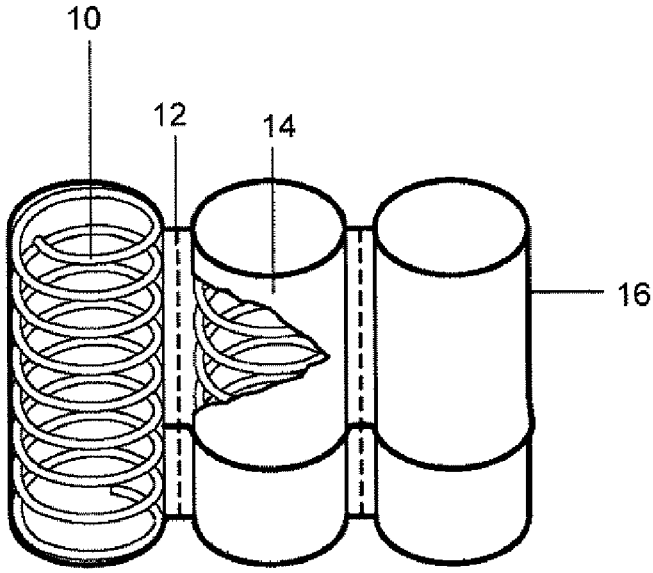
FIG. 1 is a perspective view of a group of three attached pocket coils.

FIG. 1 illustrates a perspective view of three pocket coils 16. The pocket coils 16 comprise a spring 10, of a type used in the construction of mattresses, individually wrapped in a material. The material that wraps/encloses the spring (or pocket material 14) is preferably made from fabric, however the pocket material 14 can be made from a variety of other substances, including but not limited to plastic or paper. The pocket coils 16 are attached to each other via connecting material 14. The connecting material 12 connects the pocket coils 16, and in particular the pocket material 14 surrounding the spring coils 10. This connecting material 12 is preferably made from the same material as the pocket material 14 (i.e. fabric). However, the connecting material 12 can also be made from a variety of different materials, including but not limited to plastic or paper.

The connecting material 12 is useful in a variety of ways, including assisting in the alignment of the pocket coils 16 during manufacture and use. If liquid foam is used to create side edges, for instance by pouring into a mold along the sides of the mattress, the connecting material 12 can assist by keeping liquid foam from entering into the spaces between the coils in the interior of the mattress.

Figure 2:
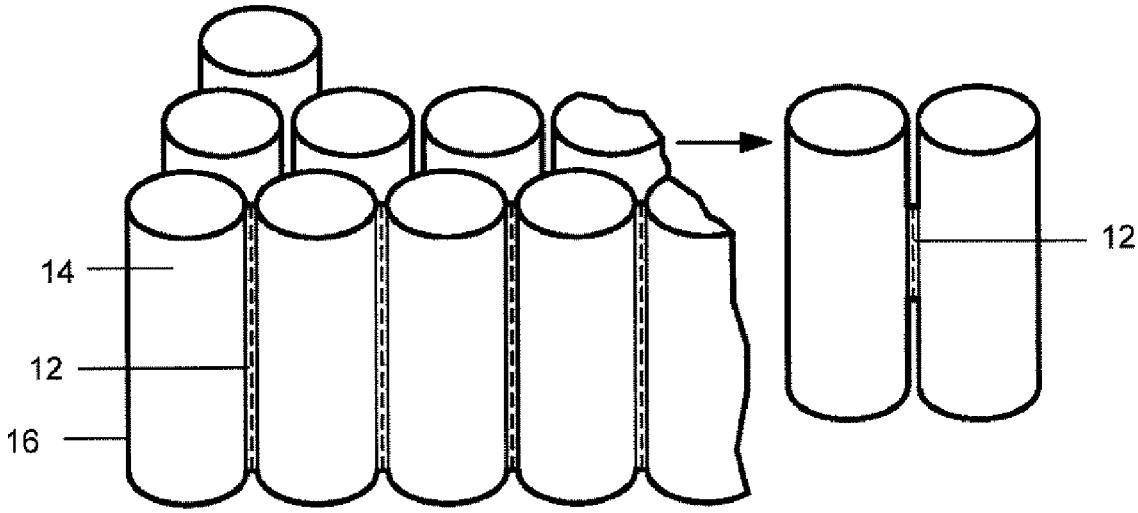
FIG. 2 is a perspective view of attached pocket coils.

FIG. 2 illustrates a connected group of pocket coils 16. Ideally, the pocket coils 16 are arranged in rows and columns such that they form the approximate shape of the mattress. In most instances, this will be a rectangular shape. However, the mattress can be made into other shapes as well. The connecting material 12 between the pocket coils 16, along the exterior edges of the mattress, is preferably sized such that the pocket coils 16 are attached via the connecting material along the full length of the pocket coil. As discussed above, if liquid foam is used to create side edges, for instance by pouring into a mold along the sides of the mattress, the connecting material 12 can assist by keeping liquid foam from entering into the spaces between the coils into the interior of the mattress. The length of the connecting material 12 attaching the interior coils may attach a smaller portion of the pocket material 14, and in fact this may provide for greater efficiency, since presumably less connecting material 12 could be used to connect the pocket coils 16.

Figure 3:
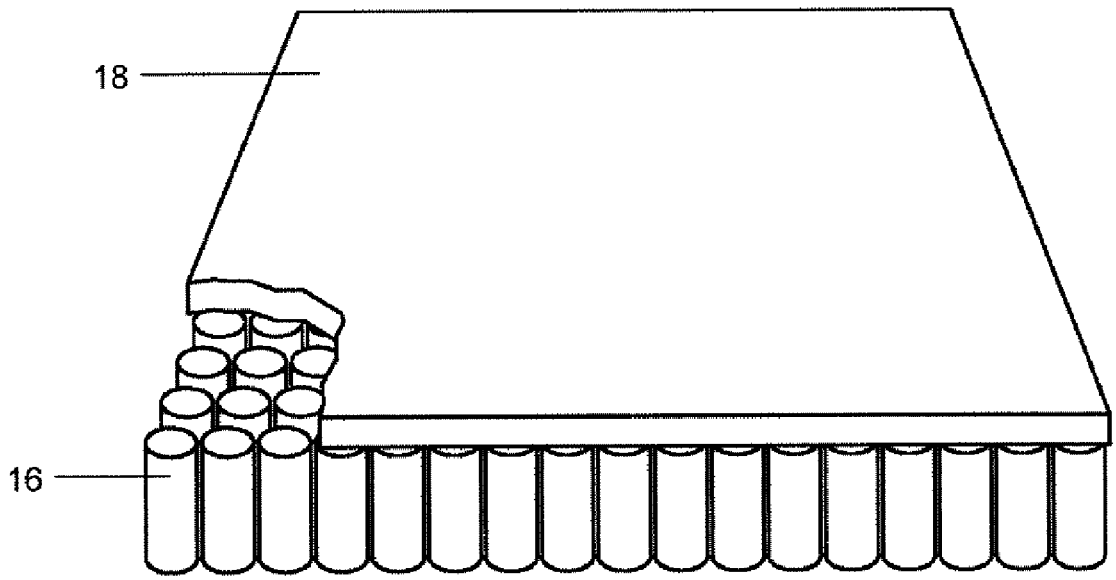
FIG. 3 is a perspective view of an aggregation of pocket coils, with a foam layer covering.

FIG. 3 illustrates a foam layer 18 placed onto one side of an aggregations of pocket coils 16 arranged into the generally rectangular shape of a mattress. The foam layer 18 shown atop the pocket coils 16 is preformed, and sized and shaped to cover a generally rectangular shaped aggregation of pocket coils 16. In alternate embodiments, the foam layer 18 need not be pre-formed into the general shape of the mattress. The foam layer can be cut from a roll of foam to create the desired size. In this figure, a section of the foam layer 18 has been removed to show the pocket coils 16 below. The foam layer 18 is glued or otherwise affixed to the pocket coils 16.

In an alternate embodiment, the foam layer 18 can be wrapped around the pocket coils such that the foam layer fully encases the pocket coils 16. This alternate embodiment may also utilize an edge support that uses liquid foam that affixes itself to the body of the mattress as it cures.

Figure 4:
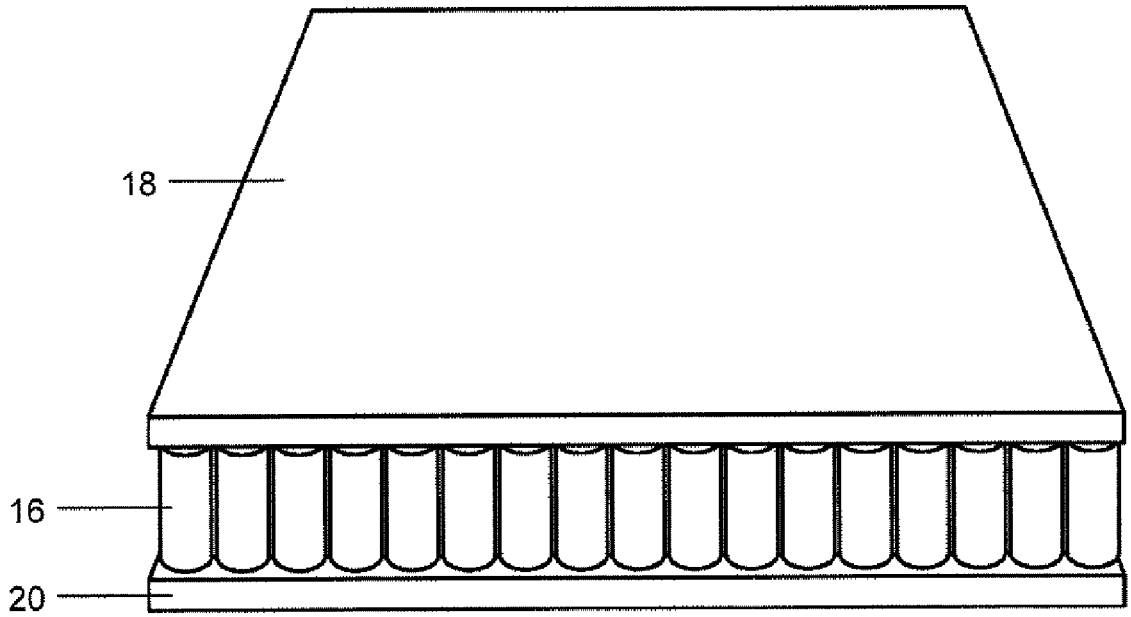
FIG. 4 is a perspective view of an aggregation of pocket coils, with foam layers affixed top and bottom.

FIG. 4 is a perspective view of an embodiment of the invention. This drawing adds an additional element to the apparatus shown in FIG. 3, namely a second layer of foam 20. This second layer of foam 20 is preferably sized and shaped like the first foam layer 18 shown in FIG. 3. The second layer of foam 20 is placed, and affixed, to the opposite ends of the pocket coils 16 that come into contact with the first foam layer 18 shown in FIG. 3. The first and second foam layers can be of identical thickness, firmness, and/or resiliency. This would allow the user to flip the mattress without noticing a difference in the feel or performance of the mattress. However, the first and second foam layers could be made with substantially different thicknesses, firmness, and/or resiliencies. This would allow the user to vary the feel and/or performance of the mattress simply be flipping the mattress. Similarly, the foam layers 18, 20 could be sectionalized such that half of the layer could vary in thickness and/or resiliency from the other half. This would allow for differing preferences of two users of the bed.

Figure 5:
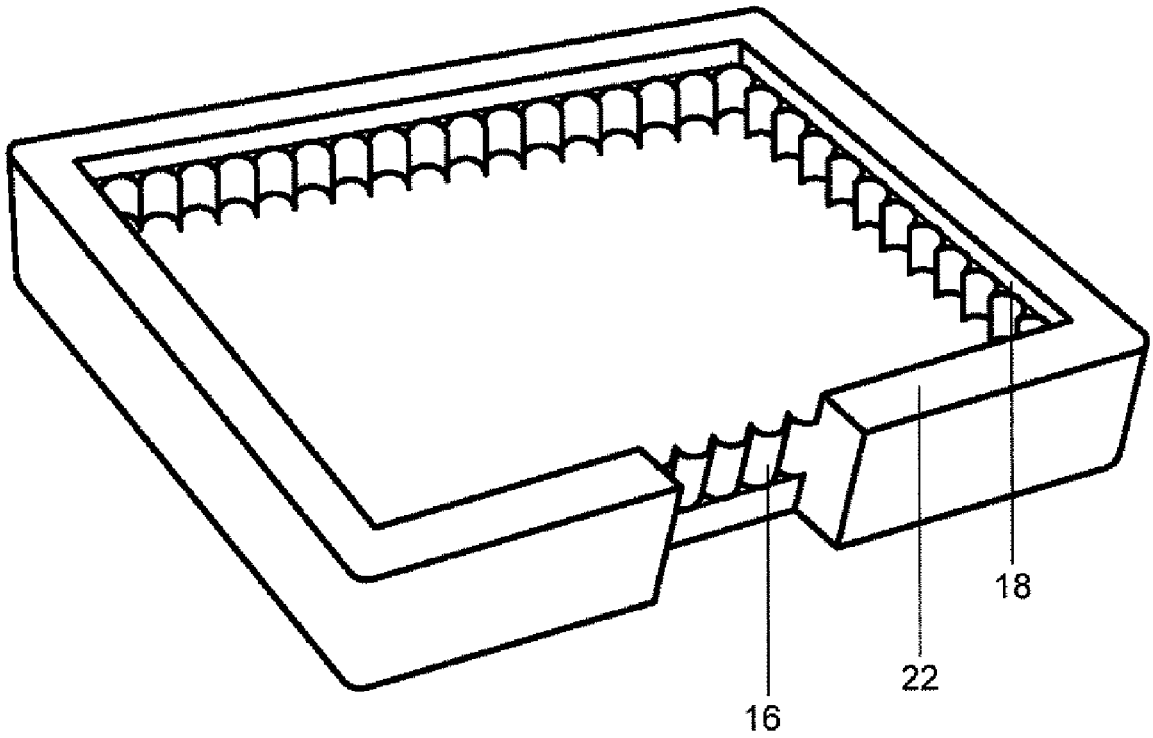
FIG. 5 is a perspective view of various elements of the invention.

FIG. 5 illustrates various elements of the invention. The outside rows/columns, or in other words, the periphery of the pocket coils 16 is shown. The top and bottom foam layers 18, 20 are not fully shown in this drawing so that other elements are more easily visualized. Only the edge of the first foam layer 18 is shown. This drawing illustrates foam edge support 22 that is located around the sides of the mattress, and attached to the periphery of the pocket coils 16. The foam edge support 22 can be placed on all four sides of the mattress. The edge support 22 is preferably placed around the mattress by pouring liquid foam into a mold surrounding the sides of the mattress. The height of the mold will preferably be substantially similar to the height of the sides of the mattress, or in other words, the height of the pocket coils and the first and second foam layers above and below the pocket coils. This height will allow the foam edge support to naturally affix itself to both the periphery of the pocket coils and the sides of the first and second foam layers when the liquid foam cures.

As discussed above, the mold for the edge support preferably provides space between itself and all four sides of the mattress. Liquid foam, preferably polyurethane foam, is poured or injected into the mold. The liquid foam is allowed to come into contact with the pocket coil material on the periphery of the mattress. However, since the pocket material on the sides/periphery is connected and contiguous, the liquid foam does not substantially penetrate into the interior of the mattress. The liquid foam is then allowed to cure and become permanently affixed to the sides of the mattress. A purpose of the mold is to allow for the creation of foam sides/edges to the mattress. The foam sides bond with the pocket coils 16 on the periphery of the mattress and the first and second foam layers 18, 20, thus providing support to the entire mattress. As such, the liquid foam, once it cures and becomes solid, provides edge support for the mattress.

Figure 6:
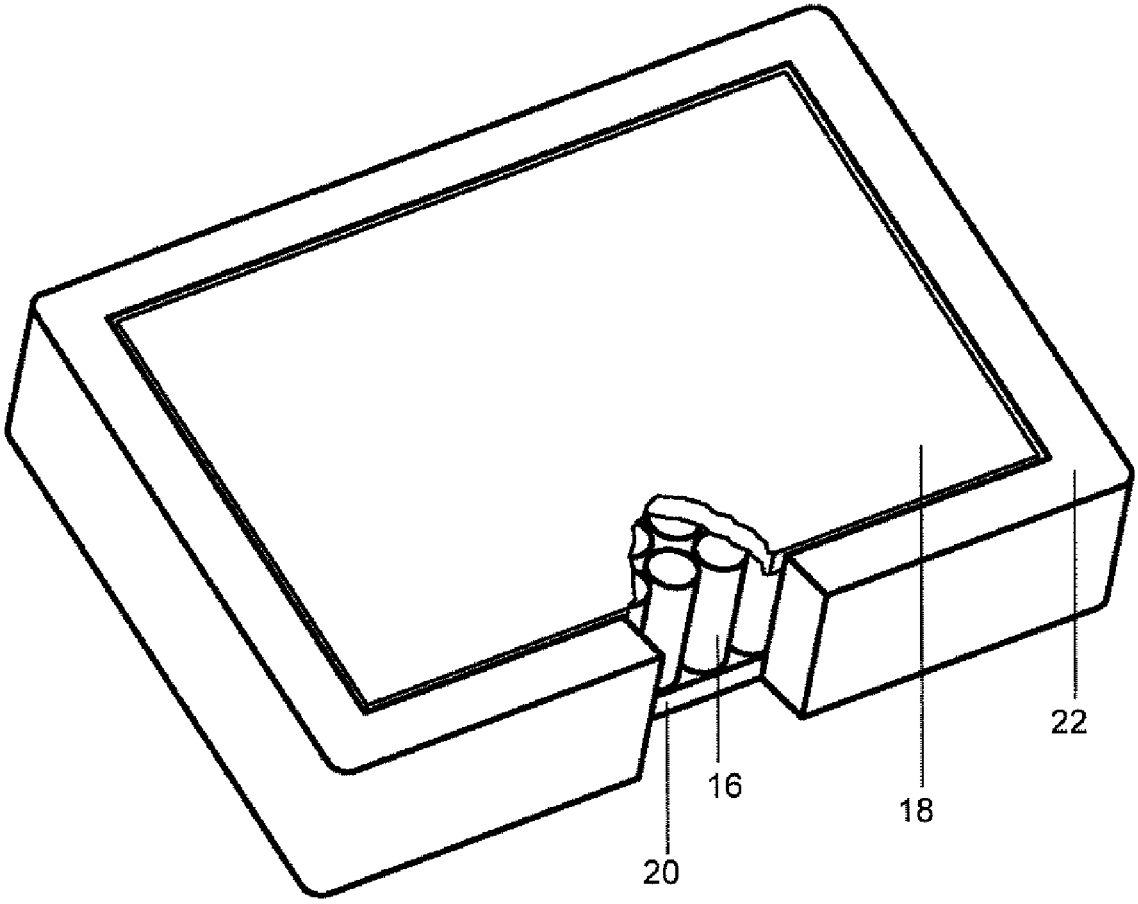
FIG. 6 is a perspective view of an embodiment of the invention.

FIG. 6 is a perspective view of an embodiment of the invention. A portion of the first foam layer 18, as well as a portion of the edge support 22 has been removed for improved visualization. As shown, one side of the aggregation of pocket coils 16 is in contact and preferably affixed to a first foam layer 18. Similarly, the other side of the aggregation of pocket coils 16 is in contact with the second foam layer 20. The foam edge support 22 is shown surrounding the periphery of the apparatus.

What is claimed is:

1. A mattress comprising:

(a) a plurality of independent spring pocket coils, wherein each spring pocket coil is enclosed in an individual pocket of material, each spring pocket coil and its pocket material having a first end and a second end and wherein the pocket coils are arranged in a generally side by side configuration;

(b) a first layer of flexible foam secured to the first ends of each pocket coil's pocket material;

(c) a second layer of flexible foam secured to the second ends of each pocket coil's pocket material; and (d) a foam edge support in contact with the pocket coils and first and second foam layers on the periphery of the mattress, wherein peripheral pocket coils of the plurality of pocket coils are arranged along the entire periphery of the mattress, and wherein the foam edge support is molded around and bonded to the periphery of each peripheral pocket coil and is permanently affixed to each peripheral pocket coil.

2. A mattress comprising:

(a) a plurality of independent spring pocket coils, wherein each spring pocket coil is enclosed in an individual pocket of material, each spring pocket coil and its pocket material having a first end and a second end, and wherein the pocket coils are arranged in a generally side by side configuration;

(b) a layer of pre-formed foam enclosing the pocket coils; and (c) a foam edge support in contact with the pre-formed foam layer on the sides of the mattress, wherein peripheral pocket coils of the plurality of pocket coils are arranged along the entire periphery of the mattress, and wherein the foam edge support is molded around and bonded to the periphery of each peripheral pocket coil and is permanently affixed to each peripheral pocket coil.

3. The mattress of claims 1 or 2 wherein the flexible foam layer(s) are made from polyurethane.

4. The mattress of claim 1, wherein each peripheral pocket coil is attached by a connecting material to each adjacent peripheral pocket coil of the plurality of pocket coils from the first end to the second end of each peripheral pocket coil.

5. The mattress of claim 2, wherein each peripheral pocket coil is attached by a connecting material to each adjacent peripheral pocket coil from the first end to the second end of each peripheral pocket coil.

* * * * *